US006698879B1

(12) United States Patent
Hindriks et al.

(10) Patent No.: US 6,698,879 B1
(45) Date of Patent: Mar. 2, 2004

(54) PRINTING TEXTILE USING AN INKJET PRINTER

(75) Inventors: Jakobus Hindriks, Coevorden (NL); Peter Hollanders, Eindhoven (NL); Andreas Thomas Johannes Dorsch, Coevorden (NL); Richard Amout Otto Pennekamp, Coevorden (NL)

(73) Assignee: Color Wings B.V., Coevorden (NL)

( * ) Notice: Subject to any disclaimer, the term of this patent is extended or adjusted under 35 U.S.C. 154(b) by 0 days.

(21) Appl. No.: 09/646,329

(22) PCT Filed: Mar. 19, 1999

(86) PCT No.: PCT/NL99/00155

§ 371 (c)(1),
(2), (4) Date: Feb. 9, 2001

(87) PCT Pub. No.: WO99/47354

PCT Pub. Date: Sep. 23, 1999

(30) Foreign Application Priority Data

Mar. 19, 1998 (NL) ..... 1008641

(51) Int. Cl.[7] ..... B41J 2/01
(52) U.S. Cl. ..... 347/105; 347/102
(58) Field of Search ..... 347/101, 102, 347/105, 106, 104, 100, 96

(56) References Cited

U.S. PATENT DOCUMENTS

| | | | | |
|---|---|---|---|---|
| 5,764,263 A | * | 6/1998 | Lin | 347/101 |
| 6,030,076 A | * | 2/2000 | Yoshimura et al. | 347/106 |
| 6,036,307 A | * | 3/2000 | Hakamada et al. | 347/106 |
| 6,048,059 A | * | 4/2000 | Wafler | 347/102 |
| 6,168,269 B1 | * | 1/2001 | Rasmussen et al. | 347/102 |

FOREIGN PATENT DOCUMENTS

| | | |
|---|---|---|
| EP | 0 566 540 A | 10/1993 |
| EP | 0 621 367 A1 | 10/1994 |
| EP | 0 633 345 A2 | 1/1995 |
| EP | 0 633 346 A3 | 1/1995 |
| EP | 0 633 347 A2 | 1/1995 |
| EP | 0 640 479 A1 | 3/1995 |
| EP | 0 646 460 A1 | 4/1995 |
| EP | 0 666 180 | 12/2002 |
| JP | 60-157867 | 8/1985 |
| JP | 4-220348 | 8/1992 |
| WO | WO 95/19266 | 7/1995 |

OTHER PUBLICATIONS

Patent Abstracts of Japan vol. 98, No. 11, Sep. 30, 1998 & JP 10 168765 A (Sharp Corp), Jun. 23, 1998.

Patent Abstracts of Japan vol. 16, No. 569 (M–1343), Dec. 9, 1992 & JP 04 220348 A (Canon Inc), Aug. 11, 1992.

Patent Abstracts of Japan vol. 9, No. 322 (M–440), Dec. 18, 1985 & JP 60 157867 A (Toray KK), Aug. 19, 1985.

* cited by examiner

*Primary Examiner*—Stephen D. Meier
*Assistant Examiner*—Ly T Tran
(74) *Attorney, Agent, or Firm*—Pearne & Gordon LLP

(57) ABSTRACT

To print air-permeable textile material (8), successive areas (5) of the textile material (8) to be printed are brought incrementally into an area (5) covered by at least one ink jet print head (1). By means of the ink jet print head (1) ink is selectively applied to the textile, according to predetermined picture information. Ink applied to the textile material (8) is finally subjected to a treatment for fixing the ink. By keeping the textile material (8) tensioned in the area (5) covered by the ink jet print head (1) over a free space (28) on the side of the textile material (8) remote from the ink jet print head (1), an improved penetration and adhesion of the ink and a limitation of the spreading of the ink are ensured. Furthermore, an apparatus for printing textile tensioned over a free space is described.

19 Claims, 2 Drawing Sheets

PRINTING TEXTILE USING AN INKJET PRINTER

Figure 1:
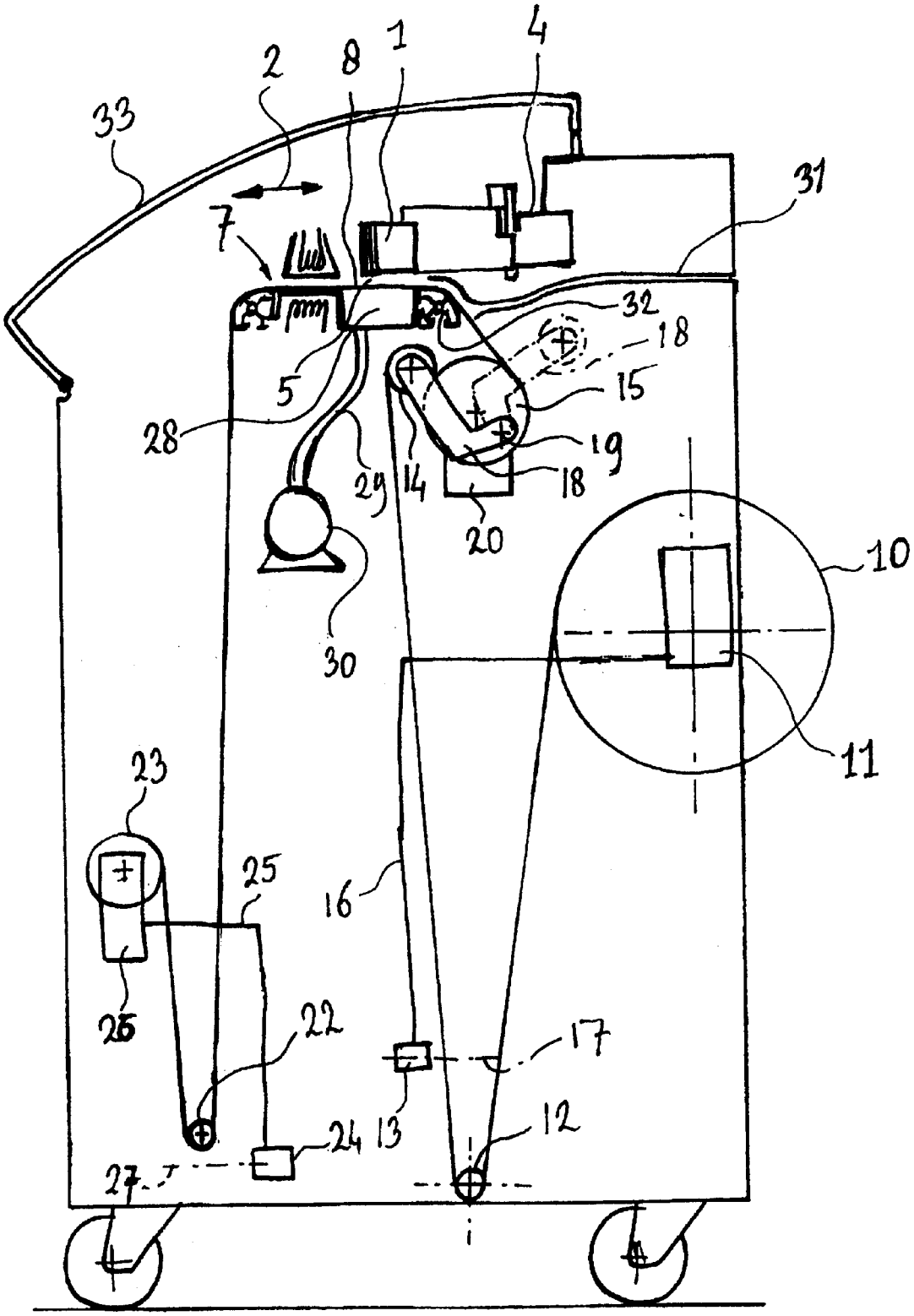

The invention relates to a method and apparatus for printing air-permeable textile material.

Such a method and such an apparatus are known from European patent application 0 633 345. Also, European patent applications 0 633 346 and 0 633 347 describe such apparatuses.

In comparison with the more conventional transfer system, in which first printing is effected on a paper carrier in reverse using an ink jet printer and then the pattern applied is transferred to textile by sublimation, such known methods and apparatuses have the advantage that the intermediate step of printing on paper and attendant losses of time, paper and printing ink are prevented.

A drawback of using these known methods and apparatuses is, however, that relatively much ink does not sufficiently adhere to the textile, as a result of which it separates during use and when washing the textile. In general, it is necessary for this reason to wash such products before use so as to prevent staining.

Another drawback of using these known methods and apparatuses is that the print sharpness is affected by the spreading of the ink as soon as it has been applied to the textile material.

It is an object of the invention, when printing textile directly by means of an ink jet printer, to ensure a better take-up of the ink in the textile, on the one hand, and, on the other hand, to limit the spreading of ink.

This object is achieved by carrying out a method according to the present invention which preferably includes incrementally bringing successive areas of a textile material to be printed into an area covered by at least one ink jet print head, selectively applying ink to the textile material by means of the ink jet print head according to predetermined picture information, and subjecting the applied ink to a treatment for at least fixing the ink. Preferably, the textile material is kept tensioned in the area covered by the ink jet print head over a free space on the side of the textile material remote from the ink jet print head. In order to be able to carry out the printing of textile in this manner, the invention further provides for an apparatus to carry out the above-described method. Preferably, the apparatus includes at least one ink jet print head reciprocable to cover a particular print area, a print head control for controlling the movement and ink delivery by the aforementioned ink jet print head, a guide table for guiding textile material to be printed in the area covered by the print head, and a conveying structure for incrementally bringing successive parts of the textile material to be printed into the area covered by the ink jet print head.

By effecting each printing on a part of the textile material behind which a free space is situated, and which is thus not in contact with a surface located behind it, discharged ink is less impeded to rapidly penetrate far into the textile material. Furthermore, it is not inconvenient if a part of the ink penetrates through the textile material completely because the absence of contact with a subjacent surface in the area covered by the print head or print heads prevents smearing of penetrated ink. This ensures a rapid deep penetration of the ink transversely to the plane in which the textile extends and a limitation of the spreading parallel to the plane in which the textile extends.

Figure 2:
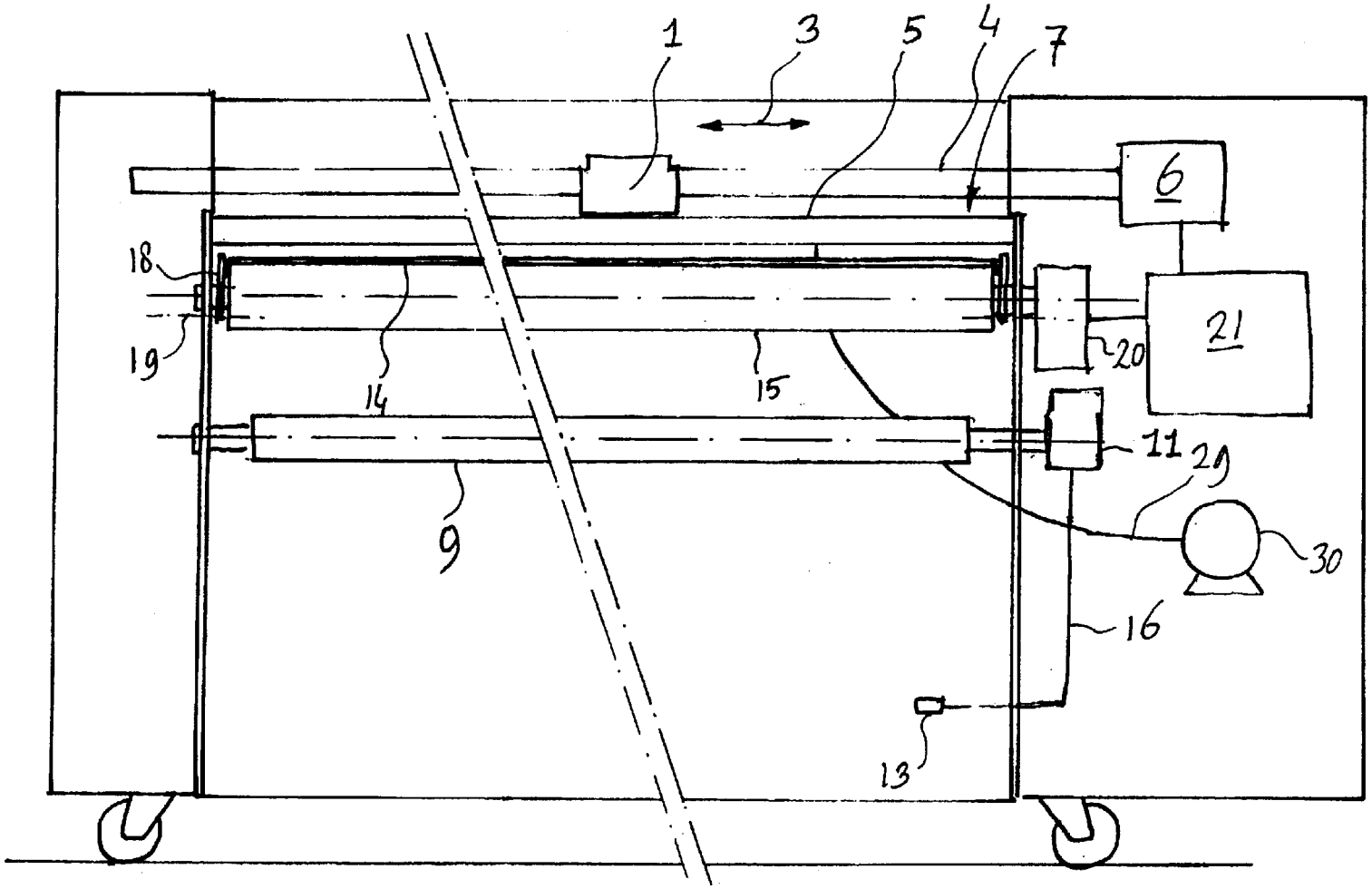

Further objects, structural aspects and structural details of the invention will be described and explained below by means of an exemplary embodiment, with reference to the drawings in which:

FIG. 1 is a slightly schematized, cut-away side view of an apparatus according to an exemplary embodiment of the invention, and FIG. 2 is a further schematized, cut-away rear view of the apparatus of FIG. 1.

The printer shown in the drawings has an assembly 1 of four print heads, mutually staggered in a textile conveying direction (arrow 2) and in a print head moving direction (arrow 3), for printing with ink in the colors yellow, magenta and cyan and with black ink. The print head assembly 1 is reciprocable along a rail 4 for covering a particular print area 5.

To control movement and ink delivery by the print head assembly 1, the apparatus comprises a print head control as schematically indicated in FIG. 2 by a block 6.

Opposite the print head assembly, a guide table 7 is situated for guiding textile material 8 to be printed (only shown in FIG. 1) in the area 5 covered by the print heads.

To stepwise bring successive parts of the textile material 8 to be printed into the area covered by the print heads 1, the apparatus has a conveying structure. Upstream of the guide table 7, this conveying structure comprises a holder 9 for carrying a roll 10 of textile to be printed, a driving unit 11 for driving rotation of the holder 9 and the roll 10, a web tensioner in the form of a ballast roller 12, a loop detector 13, a deflecting roller 14 and a conveying roller 15.

The loop detector 13 is coupled via a line 16 with the driving unit 11 for activating the driving unit 11 in reaction to the rise of the loop of the textile material passing around the ballast roller 12 above a scanning plane 17 of the detector 13. When the detector observes that the loop around the ballast roller 12 is above the plane 17, the driving unit 11 is activated to unroll the roll 10 over a particular distance. If required, a second detector can be used at a distance below the detector 11 to always unroll the same amount of textile material, irrespective of the instantaneous thickness of the roll 10.

Since the textile material, before reaching the conveying roller 15, passes over the deflecting roller 14, the textile material, in operation, abuts against the conveying roller 15 over a great part of the circumference. This has the result that at a relatively low tension on the textile web without clamping sufficient traction can be transferred to the textile web to ensure a reliable passage. To ensure a passage of the textile web without clamping, a free zone is situated, in operating, along the section of the conveying surface against which the textile material abuts. Since the textile material passes freely over the surface of the roller 15, a uniform, accurate conveyance is ensured with a very slight deformation of the web. This is of special importance to the printing of textile because such material generally has a substantially lower diagonal stiffness than paper and the use of temporary stiffenings of the textile is attended with the drawback of the necessity of the subsequent removal of the temporary stiffening.

The deflecting roller 14 is suspended in swinging means 18 capable of swinging about an axis 19 from the position indicated by full lines to the position indicated in FIG. 1 by dot-dash lines. The insertion of a paper web is simply possible if the swinging means 18 is in the position indicated in FIG. 1 by dot-dash lines. After the web has been arranged over the guide table 7 and coupled to the conveying structure downstream of the guide table 7, a loop can simply be formed by placing the ballast roller 12 between the roll 10 and the deflecting roller 14 and then unrolling the roll 10 until the ballast roller 12 has sunk to the desired level. Then the textile web can be arranged to abut against the conveying roller by swinging the swinging means 18 to the position indicated by full lines.

The conveying roller 15 is coupled with a driving unit 20 for stepwise passing the textile web 8. This driving unit 20 is controlled with the print head control 6 by a central control unit 21. The accuracy of the stepwise movements of the textile web 8 is of particular importance to the accurate connection to each other of successive strips of the pattern to be formed by the print heads 1.

On the downstream side of the area 5 covered by the print heads 1, that is to say on the side of the area 5 covered by the print heads 1 remote from the conveying roller 15, a further tension roller is located in the form of a ballast roller 22. The textile web 8 passes around the ballast roller 22 in a loop and from the ballast roller 22 to a take-up roller 23 where printed material can be stored until it is further treated in another machine so as to fix the ink.

Between the ballast roller 22 and the conveying roller 15—and thus also in the area 5 covered by the print heads—a very constant tension is kept on the textile material 8 to be printed in a very simple manner so that relative smooth textile can also be accurately conveyed and printed. This advantage is also important when printing is effected without an open space behind the textile in the area 5 covered by the print heads 1, as will be described below. This advantage, however, is of special importance when printing relatively open textile which is generally smoother, and thus harder to control, and is readily printable exactly in the presence of an open space behind the textile in the area 5 covered by the print heads 1, without using temporary stiffenings.

Since both upstream of the area 5 covered by the printer and downstream of the area 5 covered by the printer tension rollers 12, 22 are situated, the textile web between these tension rollers 12, 22 is held in equilibrium and the conveying roller 15 needs to exert only little traction on the textile web 8 to move and stop the textile web 8. This enables a very accurate control of the conveyance in the area covered by the print heads 1 with simple means at a minimum of deformations.

The traction to be exerted by the conveying surface of the conveying roller 15 on the textile web 8 is particularly limited because the ballast roller 22 downstream of the guide table 7 is slightly heavier than the ballast roller 12 on the upstream side of the guide table 7 and thus exerts a slightly greater tension force on the textile web 8. The tension difference thereby also compensates a part of the friction between the textile web 8 and the guide table 7 so that the traction to be exerted by the conveying roller 15, and thus any attendant slip, is further limited.

The take-up roller 23, too, is driven in reaction to the length of the loop passed around the ballast roller 22. To this end, a detector 24 is coupled via a line 25 with a driving unit 26 of the take-up roller 23. When the loop sinks below a detection plane 27 of the detector 24, the driving unit 26 is activated to rotate the take-up roller 23 through a particular angle in the roll-up sense. Here, too, a second detector may of course be used, in this case to stop rolling-up whenever the loop has reached a particular maximum level. Instead of the ballast rollers 12, 22, which, because of their mass and the force of gravity acting thereon, maintain a tension in the textile web 8, other types of tensioner may of course also be used, such as tension rollers operated by spring force.

The guide table is provided in the area 5 covered by the print heads 1 with a hollow space 28 open towards the print heads 1. In use, this hollow space 28 forms a free space on the side of the textile material 8 remote from the print heads 1.

In use, the textile web is conveyed stepwise over the guide table, and whenever a next part of the textile material 8 has been brought into the area 5 covered by the print heads 1, that part of the textile material 8 is printed with a strip of the total picture to be formed. The print heads 1 selectively apply ink to the textile according to predetermined picture information. In the apparatus according to this example, each part of the textile to be printed moves in four steps through the area covered by the print heads 1, after each of which steps one of the four print heads 1 applies its portion to the relevant part of the textile web 8.

By keeping the textile material tensioned in the area covered by the print heads 1 over a free space on the side of the textile material remote from the print heads, a more rapid penetration of ink into the cloth becomes possible without the risk of smearing, and lateral spreading of ink is inhibited. In particular when printing adjacent surfaces in different colors, spreading leads to discolored edges spoiling the appearance of the print.

After the ink has been applied and dried, the ink is subjected to a treatment for fixing the ink. To print polymer materials, such as polyester bunting, a sublimation ink can advantageously be used, which, by sublimation, makes a final bond with the textile and obtains its final color. Other inks, too, such as those described in European patent application 0 633 345, may be used in combination with the associated fixation treatments.

The hollow space 28 communicates via a channel 29 with a reduced pressure source 30. In operation, a reduced pressure with respect to the surroundings is thus maintained in the hollow space 28 by extracting air from that hollow space 28. This ensures a substantial further improvement of the penetration speed of the ink and further inhibits spreading of the ink. Depending on the type of cloth processed, such an effective penetration of the ink into the cloth may be secured that, after fixation, it is no longer necessary to wash the cloth. In this connection it is important that cloth with so little finish or no finish at all is used so that it can be used in unwashed condition. Very good results are obtained when printing polyester bunting with an air permeability of 20–40% and preferably 30%, the ink being sublimated with a thermosol or thermofixation treatment.

A further advantage of the extraction of air on the side of the textile material 8 remote from the print heads 1 is that slipped ink is extracted from the textile, thereby preventing or at least limiting the formation of veils and the like on the rear side of the textile web 8. Another advantage of the extraction of air through the area of the textile web 8 covered by the print heads 1 is that the air movement through the textile 8 is connected with little air movement along the print heads 1, which could thus be easily clogged.

To generate a strong, drying air current through the area covered by the print heads 1, the apparatus further comprises an air supply channel 31 opening into the area covered by the print heads 1, in which air supply channel 31 a heating element 32 is located. Air extracted through the textile material 8 is thus supplemented with preheated air, which particularly inhibits spreading of the ink.

The heating element 32 also forms a heating element of the guide table 7 and is arranged upstream of the hollow space 28 to preheat textile material 8 passed over the guide table 7. By preheating the textile material 8 before applying the ink, it is dried, whereby the ink can penetrate more rapidly and ink applied to the textile material dries more rapidly so that spreading is further inhibited. Furthermore, by preheating the textile, the effect is secured that at the moment of printing the properties of the textile hardly depend on ambient conditions, such as temperature and humidity, so that an improved controllability and reproducibility of the printing is ensured.

In the proposed printer, an efficient construction with a two-fold use of generated heat is further secured because the heating element 32 in the air supply channel 31 also forms the heating element of the guide table 7 for preheating textile material 8 passed over the guide table 7. When preheating, heat penetrated through the textile 8 is discharged and used once more to promote the drying of ink in the area 5 covered by the print heads 1.

The apparatus comprises a sealing cap 33 which forms an airtight or practically airtight seal. This ensures that extracted air is substantially supplemented via the air channel 31.

The guide table 7 further comprises a heating element 34 downstream of the hollow space 28. Furthermore, a heating element 35 is arranged above the guide table 7. These heating elements 34, 35 downstream of the hollow space 28 serve to further dry applied ink so that when winding on the roll this ink does not come off on a preceding or following layer.

What is claimed is:

1. A method for printing air-permeable textile material (8), comprising:

incrementally bringing successive areas of the textile material (8) to be printed into an area (5) covered by at least one ink jet print head (1), selectively applying ink to the textile material by means of said at least one ink jet print head (1), according to predetermined picture information, and subjecting applied ink to a treatment for at least fixing the ink to the textile material, said ink being fixed by sublimation, said textile material (8) being kept tensioned in the area (5) covered by said at least one ink jet print head (1) over a free space (28) on the side of the textile material (8) remote from said at least one ink jet print head (1).

2. A method according to claim 1, wherein in said space (28) a reduced pressure is maintained with respect to the surroundings by extracting air from said space (28).

3. A method according to claim 2, wherein air extracted through the textile material (8) is supplemented with preheated air.

4. An apparatus according to claim 2, wherein said hollow space (28) communicates with a reduced pressure source (30).

5. A method according to any claim 1, wherein the textile material (8) is preheated before applying the ink.

6. An apparatus according to claim 1, further comprising an air supply channel (31) opening into the area (5) covered by said at least one print head (1), in which air supply channel (31) a heating element (32) is located.

7. An apparatus according to claim 1, wherein upstream of said hollow space (28) said guide table (7) is provided with a heating element (32) for preheating textile material (8) passed over the guide table (7).

8. A method for printing air-permeable textile material (8), comprising:

incrementally bringing successive areas of the textile material (8) to be printed into an area (5) covered by at least one ink jet print head (1), selectively applying ink to the textile material by means of said at least one ink jet print head (1) according to predetermined picture information, and subjecting applied ink to a treatment for at least fixing the ink to the textile material, said ink being fixed by sublimation, wherein the textile material (8) is kept tensioned in the area (5) covered by said at least one ink jet print head (1) over a free space (28) on the side of the textile material (8) remote from said at least one ink jet print head (1), said free space (28) having a reduced pressure being maintained therein with respect to the surroundings by extracting air from said free space (28), at least a portion of said extracted air being drawn through the textile material (8), and wherein preheated air is supplied, in supplementation of extracted air, along an area where the textile material (8) is preheated, each said successive area of said textile material (8) being preheated before ink is applied thereto by said at least one ink jet print head (1).

9. A method for printing air-permeable textile material (8), comprising:

incrementally bringing successive areas of the textile material (8) to be printed into an area (5) covered by at least one ink jet print head (1), selectively applying ink to the textile material by means of said at least one ink jet print head (1) according to predetermined picture information, and subjecting applied ink to a treatment for at least fixing the ink to the textile material, said ink being fixed by sublimation, wherein the textile material (8) is kept tensioned in the area (5) covered by the print head (1) between a driven, circulating conveying surface and a tension roller (22) located hi a loop of the textile material (8), said tension in said loop of the textile material (8) being controlled by said tension roller (22), and said textile material (8) being transported through the area (5) covered by said at least one ink jet print head (1) at a rate that is controlled by movement of said conveying surface.

10. A method according to claim 9, wherein a supply roll (10, 23) is driven in reaction to the length of the loop passed around said tension roller (12, 22).

11. A method according to claim 9, wherein the textile material (8) passes freely over said conveying surface.

12. A method for printing air-permeable textile material (8), comprising:

incrementally bringing successive areas of the textile material (8) to be printed into an area (5) covered by at least one ink jet print head (1), selectively applying ink to the textile material by means of said at least one ink jet print head (1) according to predetermined picture information, and subjecting applied ink to a treatment for at least fixing the ink to the textile material, said ink being fixed by sublimation, wherein the textile material (8), at least before passing through the area (5) covered by said at least one print head, is passed around a first tension roller (12) located in a first loop of the textile material (8) and, after passing through the area (5) covered by said at least one print head (1), is passed around a second tension roller (22) located in a second loop of the textile material (8) and, after passing the first tension roller (12) and before passing the second tension roller (12), passes over said conveying surface, and wherein the textile material (8) is kept tensioned in the area (5) covered by the print head (1) between a driven, circulating conveying surface and at least one of said fist and second tension rollers (12, 22) located respectively in said first and second loops of the textile material (8).

13. A method according to claim 12, wherein the second tension roller (22) exerts a greater force on the textile material (8) than the first tension roller (12).

14. An apparatus for printing air-permeable textile material (8), comprising:

at least one ink jet print head (1) reciprocable to cover a particular print area (5) for selectively applying ink to the textile material by means of said at least one ink jet print head (1), according to predetermined picture information, means for subjecting applied ink to a sublimation treatment for at least fixing the ink to the textile material by sublimation, a print head control (6) for controlling movement and ink delivery by said at least one ink jet print head (1), a guide table (7) for guiding textile material (8) to be printed in the area (5) covered by said at least one print head (1), and a conveying structure (9, 11, 12, 14, 15, 18, 20, 22, 23, 25) for incrementally bringing successive parts of the textile material (8) to be printed into said area (5) covered by said at least one ink jet print head (1), wherein the guide table (7) is provided in the area (5) covered by said at least one ink jet print head (1) with a hollow space (28) open towards said at least one ink jet print bead (1) to form a free space (28) situated on the side of the textile material (8) remote from said at least one ink jet print head (1), said hollow space (28) being in fluid communication with a reduced pressure source (30), said guide table having a heating element (32) for preheating said textile material upstream of said hollow space (28) of said guide table (7), said apparatus further comprising an air supply channel (31) opening into the area (5) covered by said at least one print head (1), in which air supply channel (31) said heating element (32) is located, said heating element (32), in addition to preheating said textile material (8) passed over the guide table (7) upstream of said hollow space (28), being effective to preheat air supplied to said print area (5) via said air supply channel (31).

15. An apparatus for printing air-permeable textile material (8), comprising:

at least one ink jet print head (1) reciprocable to cover a particular print area (5) for selectively applying ink to the textile material by means of said at least one ink jet print head (1), according to predetermined picture information, means for subjecting applied ink to a sublimation treatment for at least fixing the ink to the textile material by sublimation, a print head control (6) for controlling movement and ink delivery by said at least one ink jet print head (1), a guide table (7) for guiding textile material (8) to be printed in the area (5) covered by said at least one print head (1), and a conveying structure (9, 11, 12, 14, 15, 18, 20, 22, 23, 25) for incrementally bringing successive parts of the textile material (8) to be printed into said area (5) covered by said at least one ink jet print head (1), wherein the conveying structure comprises a driven, circulating conveying surface and first and second tension rollers (12, 22) suspended in first and second loops respectively of the textile material (8) located on either side of the area (5) covered by the print head (1).

16. An apparatus according to claim 15, wherein the conveying structure comprises at least one first tension roller (12) located upstream of the area (5) covered by the printer and at least one second tension roller (22) located downstream of the area (5) covered by the printer, and at least one conveying surface located in the conveying direction (2) between said tension rollers.

17. An apparatus according to claim 16, wherein the second tension roller (22) is arranged to exert a greater force on the textile material (8) than the first tension roller (12).

18. An apparatus according to claim 15, wherein, in operating condition, the textile material (8) passes over a section of said conveying surface and a free zone extends along said section of said conveying surface for passing textile material (8) without clamping.

19. An apparatus for printing air-permeable textile material (8), comprising:

at least one ink jet print head (1) reciprocable to cover a particular print area (5) for selectively applying ink to the textile material by means of said at least one ink jet print head (1), according to predetermined picture information, means for subjecting applied ink to a sublimation treatment for at least fixing the ink to the textile material by sublimation, a print head control (6) for controlling movement and ink delivery by said at least one ink jet print head (1), a guide table (7) for guiding textile material (8) to be printed in the area (5) covered by said at least one print head (1), and a conveying structure (9, 11, 12, 14, 15, 18, 20, 22, 23, 25) for incrementally bringing successive parts of the textile material (8) to be printed into said area (5) covered by said at least one ink jet print head (1), wherein the conveying structure comprises a driven, circulating conveying surface, first and second tension rollers (12, 22) suspended in first and second loops respectively of the textile material (8) located on either side of the area (5) covered by the print head (1), at least one supply roll (10, 23), at least one drive (11, 26) for rotating the at least one supply roll (10, 23), and at least one detector (13, 24) for detecting the position of at least one of said loops around at least one of said tension rollers (12, 22), which at least one detector (13, 24) is coupled with said at least one drive (11, 26) for activating said drive (11, 26) in reaction to the detection of a particular position of at least one of said first and second loops around the respective tension roller (12, 22).

* * * * *

UNITED STATES PATENT AND TRADEMARK OFFICE

CERTIFICATE OF CORRECTION

PATENT NO. : 6,698,879 B1
DATED : March 2, 2004
INVENTOR(S) : Jakobus Hindriks et al.

It is certified that error appears in the above-identified patent and that said Letters Patent is hereby corrected as shown below:

Column 6,
Line 29, please delete “hi” and insert therefor -- in --.

Signed and Sealed this

Thirteenth Day of July, 2004

JON W. DUDAS
*Acting Director of the United States Patent and Trademark Office*